US009259055B1

(12) United States Patent
Raynor

(10) Patent No.: US 9,259,055 B1
(45) Date of Patent: Feb. 16, 2016

(54) FOOTWEAR ACCESSORY DEVICE

(76) Inventor: Belinda M. Raynor, Miami, FL (US)

( * ) Notice: Subject to any disclaimer, the term of this patent is extended or adjusted under 35 U.S.C. 154(b) by 846 days.

(21) Appl. No.: 13/593,800

(22) Filed: Aug. 24, 2012

(51) Int. Cl.
*A43B 23/24* (2006.01)
*A43C 7/00* (2006.01)
*A43C 7/04* (2006.01)

(52) U.S. Cl.
CPC . *A43C 7/04* (2013.01); *A43C 7/005* (2013.01); *Y10T 24/3428* (2015.01); *Y10T 24/3705* (2015.01); *Y10T 24/3716* (2015.01)

(58) Field of Classification Search
CPC ..... A43C 7/04; A43C 7/005; Y10T 24/3705; Y10T 24/3716; Y10T 24/3428; A43D 8/28; A43D 8/32; A43D 8/34
USPC ..... 132/276, 278
See application file for complete search history.

(56) References Cited

U.S. PATENT DOCUMENTS

| | | | | | |
|---|---|---|---|---|---|
| 1,190,724 | A | | 7/1916 | Chadwick | |
| 2,877,526 | A | | 3/1959 | Simpson | |
| 3,473,198 | A | | 10/1969 | Meier | |
| 3,565,084 | A | * | 2/1971 | Jean Vuillard | 132/279 |
| 3,805,813 | A | * | 4/1974 | Laughton | 132/279 |
| 4,553,293 | A | | 11/1985 | Blum | |
| 4,912,944 | A | * | 4/1990 | Crosley et al. | 63/29.2 |
| 4,991,607 | A | * | 2/1991 | Chen | 132/278 |
| 5,259,405 | A | * | 11/1993 | Hua-Chou | 132/279 |
| 5,566,477 | A | | 10/1996 | Mathis et al. | |
| 5,649,342 | A | | 7/1997 | D'Andrade et al. | |
| 5,671,517 | A | | 9/1997 | Gourley | |
| 5,709,231 | A | * | 1/1998 | Yasuda | 132/278 |
| 5,718,021 | A | * | 2/1998 | Tatum | 24/712.2 |
| 5,778,500 | A | | 7/1998 | Illingworth | |
| 5,857,220 | A | | 1/1999 | Erny et al. | |
| 5,857,469 | A | * | 1/1999 | Sowell | 132/275 |
| 5,862,814 | A | * | 1/1999 | Janik et al. | 132/275 |
| 5,894,850 | A | * | 4/1999 | Kimura | 132/279 |
| 5,913,483 | A | | 6/1999 | Polk | |
| 6,311,700 | B1 | * | 11/2001 | Yeh | 132/279 |
| 6,546,649 | B1 | | 4/2003 | Tobias | |
| 6,601,323 | B2 | | 8/2003 | Tsujino et al. | |
| 7,117,616 | B2 | | 10/2006 | Hull | |
| 7,237,347 | B2 | | 7/2007 | Tobias | |
| 7,404,242 | B1 | | 7/2008 | Perler | |
| 7,444,724 | B1 | | 11/2008 | Perrler | |
| 7,540,290 | B2 | * | 6/2009 | Chou | 132/278 |
| 2002/0083620 | A1 | | 7/2002 | Tsujino | |
| 2004/0055617 | A1 | * | 3/2004 | Brantley | 132/278 |
| 2005/0125972 | A1 | | 6/2005 | Gibson | |
| 2006/0266377 | A1 | * | 11/2006 | Hsuwen | 132/278 |

* cited by examiner

*Primary Examiner* — Robert J Sandy
(74) *Attorney, Agent, or Firm* — Albert Bordas, P.A.

(57) ABSTRACT

A footwear accessory device, having a frame assembly with a top face and a bottom face. The top face has first fastening means and the bottom face has a spring member with a spring force. Protruding from the frame assembly are first and second tabs and hinge arms. An actuating arm is hingedly mounted onto the frame assembly. The actuating arm further comprises longitudinal members, at least one transversal member, and locking members. The locking members receive their respective first and second tabs when the first and second tabs are biased towards their respective locking members, thus overcoming the spring force when a shoelace knot is positioned between the spring member and the actuating arm to cover a shoelace to prevent the loosening or untying of the tied shoelace knot. At least one interchangeable assembly has second fastening means that secures onto the first fastening means.

3 Claims, 3 Drawing Sheets

FOOTWEAR ACCESSORY DEVICE

BACKGROUND OF THE INVENTION

1. Field of the Invention

The present invention relates to apparel, and more particularly, to accessory devices for footwear having shoelaces.

2. Description of the Related Art

Applicant believes that one of the closest references corresponds to U.S. Patent Application Publication No. 20050125972 A1, published on Jun. 16, 2005 to Gibson for a lace-trapping device. However, it differs from the present invention because Gibson teaches a lace-trapping device that comprises a strip of material that has a closure means. It is either attachable to the laces of a piece of footwear or built into the footwear at a point well below the top of the laces where they are tied so the device does not interfere with tying the laces. It is capable of closing over the lace ends after the laces are tied. Laces are threaded through a hole in the flexible material and then through the footwear eyelets at the low point of the laces. Hook and loop fasteners on overlapping strips, or flexible interlocking tensioned arms, two overlapping parts of a tension ring with mating teeth, or a pronged snap fastener secure the device to lock in the tied ends of the lacing.

Applicant believes that another reference corresponds to U.S. Patent Application Publication No. 20020083620 A1, published on Jul. 4, 2002 to Tsujino for a shoelace cover. However, it differs from the present invention because Tsujino teaches a shoelace cover for use with an athletic shoe for covering the shoelaces to prevent the loosening or untying of a tied shoelace bow, particularly applicable to wrestling shoes wherein the physical contact between wrestlers often causes the wrestling shoes to become untied. The shoelace cover generally includes a length of material with ends that can be interconnected to form an adjustable cuff for extending about one's ankle. A front portion includes apertures for shoelaces to extend through the cover. Preferably, the shoelaces extend from the shoe to pass through the apertures of the cover and then back to the shoe to secure the cover to the shoe. The front portion includes a pocket on a backside. The shoelaces can be tied into a shoelace bow, tucked into the pocket, and the ends of the cuff can be secured about one's ankle to retain the shoelace within the pocket under the cover.

Applicant believes that another reference corresponds to U.S. Pat. No. 7,444,724 B1 issued to Perrler on Nov. 4, 2008 for a lace securing apparatus. However, it differs from the present invention because Perrler teaches a lace gripper having an upper body and a lower body that may be joined together whereby a tied lace is secured between the two bodies. Preferable the upper body is designed to receive inserts, keys, charms, lights, recording devices, alarm and locating audible signals and locating devices, to allow the user to customize the lace gripper to their personal preference. The lace gripper can additionally be utilized to maintain a memo and would be secured to an object of daily use, such as a key ring or purse. Artwork for an image for the insert can be created by using software with a preset outline of the insert. Such software can be provided in softcopy or accessible via the Internet.

Applicant believes that another reference corresponds to U.S. Pat. No. 7,404,242 B1 issued to Perrler on Jul. 29, 2008 for lace securing apparatus. However, it differs from the present invention because Perrler teaches a lace gripper comprising an upper body and a lower body that may be joined together whereby a tied lace is secured between the two bodies. Preferable the upper body is designed to receive inserts, charms, lights, recording devices, alarm and locating audible signals and locating devices, to allow the user to customize the lace gripper to their personal preference. The lace gripper can additionally be utilized to maintain a memo and would be secured to an object of daily use, such as a key ring or purse.

Applicant believes that another reference corresponds to U.S. Pat. No. 7,237,347 B2, issued to Tobias on Jul. 3, 2007 for plush toy for mounting on a shoe. However, it differs from the present invention because Tobias teaches a plush toy and methods for associating the plush toy with a shoe having at least one shoe strap with hooks and loops on an interior surface of the shoe strap. To associate the plush toy with the shoe, the shoe strap is threaded through an entrance and an exit of the plush toy. Next, hooks and loops of the shoe strap are engaged to attach the plush toy to the shoe. If there is a second shoe strap, the second shoe strap is threaded through a second entrance and a second exit of the plush toy to attach the plush toy to the shoe.

Applicant believes that another reference corresponds to U.S. Pat. No. 6,546,649 B1, issued to Tobias on Apr. 15, 2003 for plush toy for mounting on a shoe. However, it differs from the present invention because Tobias teaches a plush toy capable of being detachably mounted on a shoe having a shoelace. The plush toy comprises a body having top and bottom sides and front and back ends and at least one mechanism for detachably mounting the body on the shoe without unlacing the shoelace. Preferably the body comprises at least one hole extending through the body for insertion of a shoelace. A young child can easily and quickly decorate his shoe with the plush toy.

Applicant believes that another reference corresponds to U.S. Pat. No. 7,117,616 B2, issued to Hull on Oct. 10, 2006 for footwear and other foot-receiving devices including a removable closure system cover member. However, it differs from the present invention because Hull teaches foot-receiving devices, such as athletic or other footwear, that may be modified to provide different aesthetic looks. Such foot-receiving devices may include: a housing member at least partially defining a foot-receiving chamber; a closure system for at least partially holding the foot in the chamber; a tongue member located between at least a portion of the closure system and the foot, the tongue member including a first engagement element; and a cover member for at least partially covering the closure system, the cover member including a second engagement element that engages with the first engagement element to removably engage the cover member with the tongue member. The user can freely engage or disengage the cover member to change the aesthetic appearance of the device, e.g., depending on personal preference.

Applicant believes that another reference corresponds to U.S. Pat. No. 6,601,323 B2, issued to Tsujino, et al. on Aug. 5, 2003 for shoelace cover. However, it differs from the present invention because Tsujino, et al. teaches a shoelace cover for use with an athletic shoe for covering the shoelaces to prevent the loosening or untying of a tied shoelace bow, particularly applicable to wrestling shoes wherein the physical contact between wrestlers often causes the wrestling shoes to become untied. The shoelace cover generally includes a length of material with ends that can be interconnected to form an adjustable cuff for extending about one's ankle. A front portion includes apertures for shoelaces to extend through the cover. Preferably, the shoelaces extend from the shoe to pass through the apertures of the cover and then back to the shoe to secure the cover to the shoe. The front portion includes a pocket on a backside. The shoelaces can be tied into a shoelace bow, tucked into the pocket, and the ends of the cuff can be secured about one's ankle to retain the shoelace within the pocket under the cover.

Applicant believes that another reference corresponds to U.S. Pat. No. 5,913,483 B1, issued to Polk on Jun. 22, 1999 for shoelace and tied knot-securing apparatus. However, it differs from the present invention because Polk teaches a shoelace securing device in the form of an elongated strip of material with enlarged circular end portions that overlap upon assembly to cover the knot of a user's shoelaces. A rear side of the strip is completely covered with hook material to aid in gripping both the knot and adjacent shoelace material. The front surface has a loop patch at one end, the remainder of the front surface carrying an artistic design, other indicia, or logo. In one embodiment, the device includes two connectable, foldable strips of material. In each embodiment, a smooth surface is presented that can carry artwork, a slogan, words, a logo, or the like.

Applicant believes that another reference corresponds to U.S. Pat. No. 5,857,220 B1, issued to Erny, et al. on Jan. 12, 1999 for a strap logo. However, it differs from the present invention because Erny, et al. teaches a strap logo for a user to apply to the strap of a bag, cap, to shoestrings, or other articles having a linearly extended member comprises a logo face rotably attached to arms which encircle the strap and are, in turn, attached to each other by complementary hook and loop fastening means. As constructed, the strap logo may be temporarily attached to a variety of straps and removed at the user's option.

Applicant believes that another reference corresponds to U.S. Pat. No. 5,778,500 B1, issued to Illingworth on Jul. 14, 1998 for a knot-securing device. However, it differs from the present invention because Illingworth teaches a knot securing device of particular benefit in securing shoelace knots made from a flexible material with a region having hook elements, a region having loop elements and a pair of apertures in the flexible material for allowing the open ends of a shoelace to pass through from one surface of the material to the opposite surface of the material, wherein the shoelace is then tied in a knot and the regions with the hook and loop elements are brought into contact to form a secure, but releasable, lock around the knot.

Applicant believes that another reference corresponds to U.S. Pat. No. 5,671,517 B1, issued to Gourley on Sep. 30, 1997 for Shoe lace safety guard. However, it differs from the present invention because Gourley teaches a device to cover and retain shoelaces to prevent inadvertent snagging or other interference with the laces when wearing shoes. An inner fastener element is attached by a tab to the shoelace at the furthest lace away from the point at which the laces are tied. The shoelaces are then tied by a bow over the inner fastener element. An outer fastener element attached at a fold is then folded over onto the inner fastener element and retained by a hook and loop material to cover and retain the laces. The outer fastener element may have hook and loop material to allow attachment of emblems, reflectors and other objects.

Applicant believes that another reference corresponds to U.S. Pat. No. 5,649,342 B2, issued to D'Andrade, et al. on Jul. 22, 1997 for a decorative device for attachment to and securing of shoelaces. However, it differs from the present invention because D'Andrade, et al. teaches a device for securing shoelaces includes a base, a cover and an attachment mechanism for hingedly connecting the base and cover. The base has at least a bottom, a front and a back. The bottom has side cutouts adapted to allow a shoelace to pass therethrough. A pair of opposing slits extends from the side cutouts towards the center, but do not overlap. The opposing slits are formed so that the shoelace may pass easily from the side cutouts to the opposing slits. Each slit is sized and shaped such that it frictionally engages the shoelaces when they are pulled through it. In a further embodiment, it has a support structure, which can be attached to the footwear and then coupled with the base. In this embodiment, the base and support have complementary attachment mechanisms.

Applicant believes that another reference corresponds to U.S. Pat. No. 5,566,477 B1, issued to Mathis, et al. on Oct. 22, 1996 for a removable shoelace cover for a shoe. However, it differs from the present invention because Mathis, et al. teaches a shoelace cover incorporating an interchangeable fashion panel for covering the shoelaces of a gym shoe. The shoelace cover is secured to the shoe by a number of straps threaded through slots in the shoelace cover. A strap secured to each side of the gym shoe includes a loop and hook material such that the straps can be disengaged and the shoelace cover can be drawn back to expose the shoelaces of the shoe. The fashion panel is attached to the shoelace cover by a loop and hook material such that at the whim of the shoe wearer, the fashion panel can be replaced by other fashion panels to convey a fashion statement.

Applicant believes that another reference corresponds to U.S. Pat. No. 4,553,293 B1, issued to Blum on Nov. 19, 1985 for a reusable-tying device. However, it differs from the present invention because Blum teaches an improvement for tying devices, which can be secured to laces particularly on shoes for holding the shoelace knot in place. The device disclosed employs a mechanism for securing a portion of the device to the shoe and enabling the device to be reused for securing a knot in place each and every time the laces are tied. It also incorporates elastic or semi-rigid means for engaging the shoelace knot from opposed sides to impede the knot from becoming untied while simultaneously exposing the knot for view and maintaining the normal appearance of the bow.

Applicant believes that another reference corresponds to U.S. Pat. No. 3,473,198 B1, issued to Meier on Oct. 21, 1969 for a shoe tie retainer. However, it differs from the present invention because Meier teaches an enclosure adapted to be attached to a shoe in such a manner so that the tie of the shoe can be locked within the enclosure. The enclosure is formed of two halves, which are hingeably attached to one another and is provided with a hidden latching means, which requires the use of a thin object such as a coin to be unlocked.

Applicant believes that another reference corresponds to U.S. Pat. No. 2,877,526 B1, issued to Simpson on Mar. 17, 1959 for a shoelace clasp. However, it differs from the present invention because Simpson teaches a clasp for shoe lace including a first member with front and rear faces, a pair of space ears projecting therefrom and a spring plate intermediate the ears. A second member pivots at one end to the first member at the base of the ears. The edge of the end engages the front face of the spring plate to urge the clasp to open or closed position with the second member substantially contacting the rear face of the first member. The outer portions of the ears engage and move a lace along the second member and clamp it thereagainst upon relative pivotal movement of the members to closed position of the clasp.

Applicant believes that another reference corresponds to U.S. Pat. No. 1,190,724 B1, issued to Chadwick on Jul. 11, 1916 for a shoestring retainer. However, it differs from the present invention because Chadwick teaches a shoestring retainer including member adapted to be pushed under a shoe string bow, a resilient plate secured thereto at one edge and adapted to fly back therefrom by its own resiliency and having a projection for engaging under the edge of the member, and a lever for forcing the projection back and releasing the resilient plate.

Other patents describing the closest subject matter provide for a number of more or less complicated features that fail to solve the problem in an efficient and economical way. None of these patents suggest the novel features of the present invention.

SUMMARY OF THE INVENTION

The instant invention is a footwear accessory device, comprising a frame assembly having a first top face and a first bottom face. The first top face has first fastening means and the first bottom face has a spring member with a spring force. Protruding from the frame assembly are first and second tabs and first and second hinge arms. An actuating arm comprises first and second hinge points and is hingedly mounted onto the frame assembly. The actuating arm further comprises first and second longitudinal members, at least one transversal member, and first and second locking members. The first and second locking members receive their respective first and second tabs when the first and second tabs are biased towards their respective first and second locking members, thus overcoming the spring force when a shoelace knot is positioned between the spring member and the actuating arm. At least one interchangeable assembly has second fastening means that secures onto the first fastening means.

In a preferred embodiment, the first and second fastening means are hook or loop type fasteners. The frame assembly further comprises first and second transversal ends and first and second longitudinal ends. The at least one interchangeable assembly further comprises a second top face and a second bottom face. The second bottom face has the second fastening means thereon. The at least one interchangeable assembly further comprises third and fourth transversal ends and third and fourth longitudinal ends. The actuating arm comprises first and second ends. The first and second hinge points extend transversely from the first end. The first and second longitudinal members extend substantially parallel to each other toward the first and second locking members respectively. The actuating arm further comprises an actuating tab that extends beyond the first and second locking members and protrudes beyond the first transversal end. The at least one interchangeable assembly comprises a design and/or print thereon and at least one ornament thereon.

It is therefore one of the main objects of the present invention to provide a footwear accessory device for use with footwear for covering shoelaces to prevent the loosening or untying of a tied shoelace knot.

It is another object of the present invention to provide a footwear accessory device having first and second locking members that receive respective first and second tabs when the first and second tabs are biased towards their respective first and second locking members, thus overcoming a spring force when a shoelace knot is positioned between the spring member and the actuating arm.

It is another object of the present invention to provide a footwear accessory device having at least one interchangeable assembly comprising a design and/or print thereon and at least one ornament thereon.

It is another object of this invention to provide a footwear accessory device that can be readily assembled and disassembled without the need of any special tools.

It is another object of this invention to provide a footwear accessory device, which is of a durable and reliable construction.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
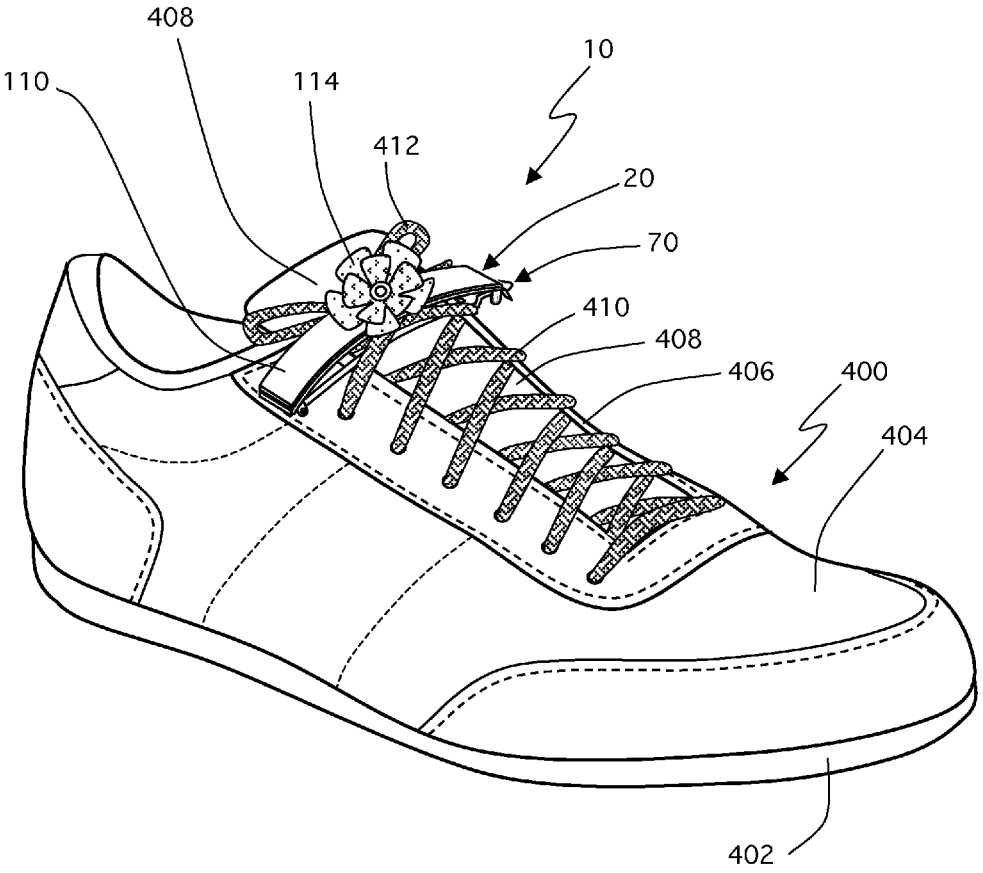
FIG. 1 is an isometric view of the present invention secured onto footwear and covering its shoelace to prevent the loosening or untying of the tied shoelace knot.

Referring now to the drawings, the present invention is generally referred to with numeral 10. It can be observed that it basically includes frame assembly 20, actuating arm 70, and interchangeable assembly 100.

As seen in FIG. 1, instant invention 10 is used on footwear having shoelaces, such as footwear 400. Footwear 400 may include, but is not limited to, athletic shoes (also known as trainers or sneakers); brothel creepers; court shoes (known in the US as pumps); diabetic shoes; espadrilles; galoshes; kitten heels; lace-up shoes including derby shoes, oxford shoes, and brogues; high-tops; loafers; mary janes; moccasins; monks; mules; platform shoes; school shoes; skate shoes; and tap shoes. As an example, footwear 400 may comprise sole 402, toe box 404, vamp 406, and tongue 408, and must comprise shoelace 410 with shoelace knot 412. Instant invention 10 is secured onto footwear 400, covering shoelace 410 to prevent the loosening or untying of the tied shoelace knot 412.

Figure 2:
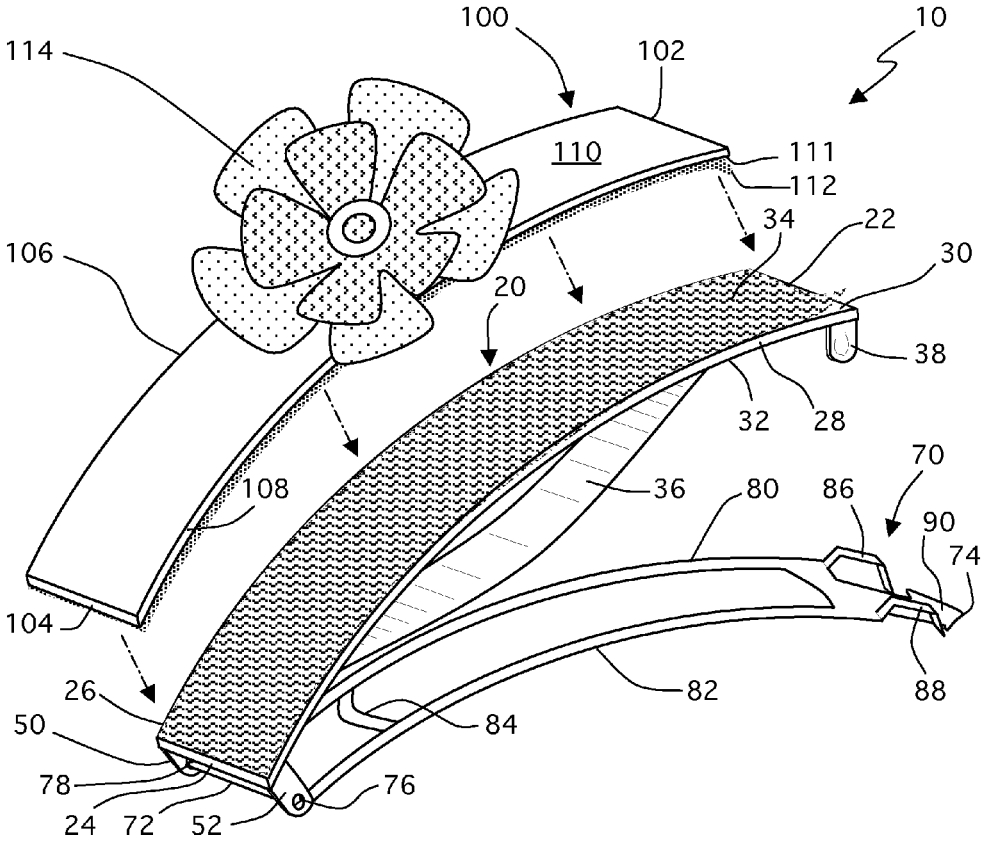
FIG. 2 is an isometric exploded view of the present invention seen in FIG. 1.

As seen in FIG. 2, instant invention 10 comprises frame assembly 20. Frame assembly 20 has top face 30 and bottom face 32. Top face 30 has first fastening means and bottom face 32 has spring member 36 with a spring force. Protruding from frame assembly 20 are tabs 38 and hinge arms 50 and 52. Frame assembly 20 further comprises transversal ends 22 and 24 and longitudinal ends 26 and 28.

Actuating arm 70 comprises hinge points 76 and 78 and is hingedly mounted onto frame assembly 20. Actuating arm 70 further comprises longitudinal members 80 and 82, at least one transversal member 84, and locking members 86 and 88. Locking members 86 and 88 receive their respective first and second tabs 38 when the first and second tabs 38 are biased towards respective locking members 86 and 88 overcoming the spring force when shoelace knot 412 is positioned between spring member 36 and actuating arm 70.

More specifically, in a preferred method for use, at shoelace knot 412 as seen in FIG. 1, actuating arm 70 is positioned between shoelace 410 and tongue 408. Meaning that actuating arm 70 is inserted below shoelace 410 and above tongue 408, and then first and second tabs 38 are biased towards respective locking members 86 and 88 overcoming the spring force so that locking members 86 and 88 receive their respective first and second tabs 38 to cover shoelace 410 and prevent the loosening or untying of the tied shoelace knot 412. It is noted that a section of spring member 36 will make contact with at least one transversal member 84 when locking members 86 and 88 receive their respective first and second tabs 38, thus further securing tied shoelace knot 412 therein.

Actuating arm 70 further comprises ends 72 and 74 whereby hinge points 76 and 78 extend transversely from end 72. Longitudinal members 80 and 82 extend substantially parallel to each other toward locking members 86 and 88 respectively. Actuating arm 70 further comprises actuating tab 90 that extends beyond locking members 86 and 88 and protrudes beyond transversal end 22.

At least one interchangeable assembly 100 has second fastening means that secures onto the first fastening means. At least one interchangeable assembly 100 further comprises top face 110, and bottom face 111 having the second fastening means thereon. At least one interchangeable assembly 100 further comprises transversal ends 102 and 104, and longitudinal ends 106 and 108. In a preferred embodiment, the first and second fastening means are a hook or loop type fastener, such as loop fastener surface 34 fixed upon top face 30 and hook fastener surface 112 fixed upon bottom face 111. At least one interchangeable assembly 100 comprises a design and/or print and/or at least one ornament 114 thereon.

Figure 3A:
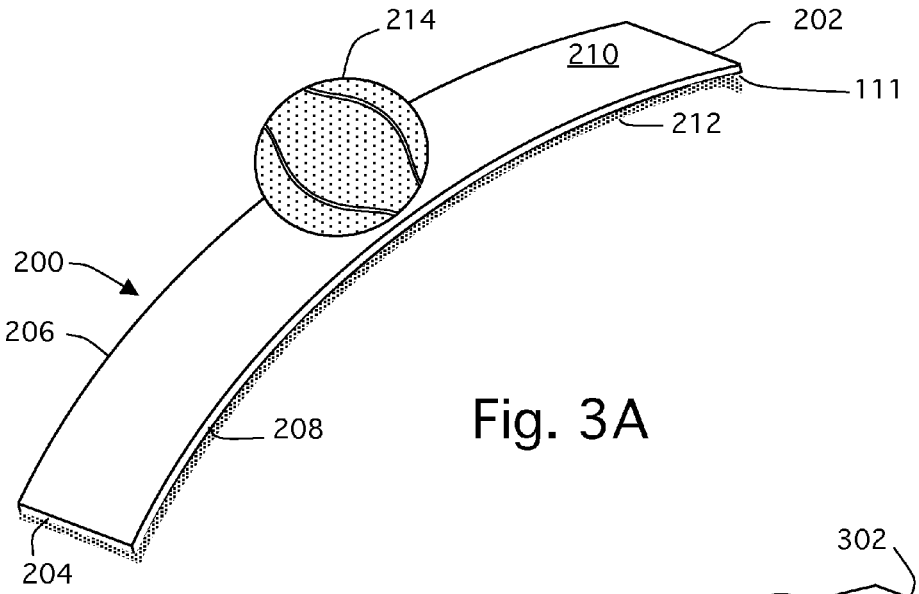
FIG. 3A is an isometric view of a first alternate embodiment of an interchangeable assembly comprising a design and/or print and at least one ornament thereon.

As seen in FIG. 3A, a first alternate embodiment of interchangeable assembly 200 has second fastening means that can secure onto the first fastening means. At least one interchangeable assembly 200 comprises top face 210, and bottom face 211 having the second fastening means thereon. At least one interchangeable assembly 200 further comprises transversal ends 202 and 204, and longitudinal ends 206 and 208. In a preferred embodiment, the first and second fastening means are a hook or loop type fastener, such as loop fastener surface 34 fixed upon top face 30 and hook fastener surface 212 fixed upon bottom face 211. At least one interchangeable assembly 200 comprises a design and/or print and/or at least one ornament 214 thereon.

Figure 3B:
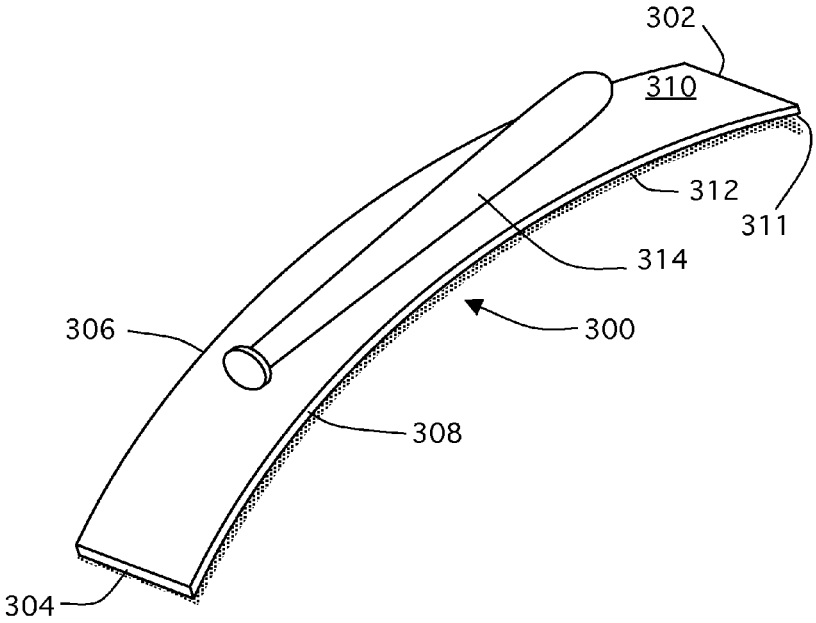
FIG. 3B is an isometric view of a second alternate embodiment of the interchangeable assembly comprising a design and/or print and at least one ornament thereon.

As seen in FIG. 3B, a second alternate embodiment of interchangeable assembly 300 has second fastening means that can secure onto the first fastening means. At least one interchangeable assembly 300 comprises top face 310, and bottom face 311 having the second fastening means thereon. At least one interchangeable assembly 300 further comprises transversal ends 302 and 304, and longitudinal ends 306 and 308. In a preferred embodiment, the first and second fastening means are a hook or loop type fastener, such as loop fastener surface 34 fixed upon top face 30 and hook fastener surface 312 fixed upon bottom face 311. At least one interchangeable assembly 300 comprises a design and/or print and/or at least one ornament 314 thereon.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A footwear accessory device, consisting of:

A) a frame assembly comprising a first top face and a first bottom face, said first top face having first means for fastening and said first bottom face having a spring member with a spring force, protruding from said frame assembly are first and second tabs and first and second hinge arms, said frame assembly further comprises first and second transversal ends and first and second longitudinal ends, said first means for fastening is a hook or loop type fastener;

B) an actuating arm comprises first and second hinge points and is hingedly mounted onto said frame assembly, said actuating arm further comprises first and second longitudinal members, at least one transversal member, and first and second locking members, said first and second locking members receive respective said first and second tabs when said first and second tabs are biased towards respective said first and second locking members overcoming said spring force when a shoelace knot is positioned between said spring member and said actuating arm, said actuating arm comprises first and second ends, said first and second hinge points extend transversely from said first end, and said first and second longitudinal members extend substantially parallel to each other toward said first and second locking members respectively, said actuating arm further comprises an actuating tab that extends beyond said first and second locking members and protrudes beyond said first transversal end; and C) at least one interchangeable assembly having second means for fastening that secures onto said first means for fastening, said second means for fastening being a hook or loop type fastener, said at least one interchangeable assembly further comprises a second top face and a second bottom face, said second bottom face having said second means for fastening thereon, said at least one interchangeable assembly further comprises third and fourth transversal ends and third and fourth longitudinal ends, said at least one interchangeable assembly comprises a design and print and at least one ornament thereon, said footwear accessory device being mounted to said shoelace knot of a footwear having a tongue, to cover a shoelace to prevent loosening or untying of said shoelace knot when tied.

2. A footwear accessory device, consisting of:

A) a frame assembly comprising a first top face and a first bottom face, said first top face having first means for fastening and said first bottom face having a spring member with a spring force, protruding from said frame assembly are first and second tabs and first and second hinge arms, said frame assembly further comprises first and second transversal ends and first and second longitudinal ends, said first means for fastening is a hook or loop type fastener;

B) an actuating arm comprises first and second hinge points and is hingedly mounted onto said frame assembly, said actuating arm further comprises first and second longitudinal members, at least one transversal member, and first and second locking members, said actuating arm comprises first and second ends, said first and second hinge points extend transversely from said first end, and said first and second longitudinal members extend substantially parallel to each other toward said first and second locking members respectively, said actuating arm further comprises an actuating tab that extends beyond said first and second locking members and protrudes beyond said first transversal end;

C) at least one interchangeable assembly having second means for fastening that secures onto said first means for fastening, said second means for fastening being a hook or loop type fastener, said at least one interchangeable assembly further comprises a second top face and a second bottom face, said second bottom face having said second means for fastening thereon, said at least one interchangeable assembly further comprises third and fourth transversal ends and third and fourth longitudinal ends, said at least one interchangeable assembly comprises a design and/or print and at least one ornament thereon; and D) footwear having a shoelace and a tongue, said first and second locking members receive respective said first and second tabs when said first and second tabs are biased towards respective said first and second locking members overcoming said spring force when a shoelace knot is positioned between said spring member and said actuating arm.

3. A footwear accessory device, consisting of:

A) a frame assembly comprising a first top face and a first bottom face, said first top face having first means for fastening and said first bottom face having a spring member with a spring force, protruding from said frame assembly are first and second tabs and first and second hinge arms, said frame assembly further comprises first and second transversal ends and first and second longitudinal ends, said first means for fastening is a first hook or loop type fastener;

B) an actuating arm comprising first and second hinge points is hingedly mounted onto said frame assembly, said actuating arm further comprises first and second longitudinal members, at least one transversal member, and first and second locking members, said actuating arm comprises first and second ends, said first and second hinge points extend transversely from said first end, and said first and second longitudinal members extend substantially parallel to each other toward said first and second locking members respectively, said actuating arm further comprises an actuating tab that extends beyond said first and second locking members and protrudes beyond said first transversal end;

C) at least one interchangeable assembly having second means for fastening that secures onto said first means for fastening, said second means for fastening being a second hook or loop type fastener, said at least one interchangeable assembly further comprises a second top face and a second bottom face, said second bottom face having said second means for fastening thereon, said at least one interchangeable assembly further comprises third and fourth transversal ends and third and fourth longitudinal ends, said at least one interchangeable assembly comprises a design and/or print and at least one ornament thereon; and D) footwear having a shoelace and a tongue, said actuating arm is inserted below said shoelace and above said tongue, said first and second locking members receive respective said first and second tabs when said first and second tabs are biased towards respective said first and second locking members overcoming said spring force when a shoelace knot is positioned between said spring member and said actuating arm to cover said shoelace and prevent loosening or untying of said shoelace knot, whereby a section of said spring member makes contact with said at least one transversal member when said first and second locking members receive respective said first and second tabs, thus further securing said shoelace knot therein.

* * * * *